US007802403B2

(12) United States Patent
Finnerty et al.

(10) Patent No.: US 7,802,403 B2
(45) Date of Patent: Sep. 28, 2010

(54) REFRIGERATION VAPOR INTRUSION RETARDANT SYSTEM AND METHOD OF INSTALLATION

(76) Inventors: Eric John Finnerty, 11393 SE. 282nd Ave., Boring, OR (US) 97009; Darryl Jackson McCrory, 275 NE. 26th, Gresham, OR (US) 97030

( * ) Notice: Subject to any disclaimer, the term of this patent is extended or adjusted under 35 U.S.C. 154(b) by 300 days.

(21) Appl. No.: 12/152,755

(22) Filed: May 16, 2008

(65) Prior Publication Data

US 2009/0282765 A1 Nov. 19, 2009

(51) Int. Cl.
*E04D 3/38* (2006.01)

(52) U.S. Cl. ..... 52/62; 52/61; 52/412

(58) Field of Classification Search ..... 52/61, 52/62, 408, 411, 412
See application file for complete search history.

(56) References Cited

U.S. PATENT DOCUMENTS 5,775,052 A * 7/1998 Mayle ..... 52/746.11

6,006,482 A * 12/1999 Kelly ..... 52/409

* cited by examiner

*Primary Examiner*—Jeanette E Chapman
*Assistant Examiner*—Daniel Kenny
(74) *Attorney, Agent, or Firm*—Mark S. Hubert

(57) ABSTRACT

Commercial meat and perishable product refrigeration buildings commonly suffer from infiltration of moisture which normally occurs at the roof/wall junction where the roof meets the walls. Warm moist outside air is drawn into the cooler because of the lower pressure therein and once inside, forms ice which lowers the cooler temperature and causes freezer burn. By removing the building roof, and installing a moisture proof 40-50 mil thick sheet polymer membrane onto the cooler wall panels, over the top sill plate and the top header ledger board then welding it at the roof perimeter to the roofing membrane, an impermeable seal can be formed. To ensure the unitary integrity of the system, a flexible polymer mastic is trawled onto the wall panels before the membrane is affixed and a double sealing strip is screwed into the membrane though the mastic and into the wall panels.

13 Claims, 5 Drawing Sheets

REFRIGERATION VAPOR INTRUSION RETARDANT SYSTEM AND METHOD OF INSTALLATION

BACKGROUND OF THE INVENTION

The present invention relates to a system and its method of installation that retards the intrusion of vapor into a refrigerated building. More particularly, an integrated roofing/wall and floor/wall membrane is mechanically and adhesively affixed about the building structure in an intertwining manner about the building members so as to prevent the ingress of moisture into the refrigerated enclosure.

Refrigerated structures such as commercial freezers, maintain a lower internal temperature and pressure than the surrounding ambient atmosphere. This causes moisture vapor ridden air to migrate into the structure wherein it condenses onto the exterior surfaces of the structural members it contacts. This results in unwanted water and ice accumulating on such items as fire suppression systems, food products, building members and the like. Besides causing rot to building members, further structural damage occurs when water infiltrates cracks and crevices in the building members and later freezes and expands.

The most typical point of ingress is the roof/wall interface and the floor/wall interface. The majority of prior art systems, while sealing a roofing system to a wall, have focused on preventing liquid water ingress rather than water vapor ingress. Generally, the prior art joins various dissimilar elements such as flashings, pleated membranes, craft paper, compression gaskets, fiberglass roofing and the like in various ways to form a retrofitted seal which to date has failed to adequately address the problem. At any interface between these various elements there is the potential for a seal failure. Further, since most prior art systems are adapted to be installed about the existing structure rather than integrated completely with the building's structural members, they often are capable of preventing much of the moisture ingress into the refrigerated structure yet leave some or partial sections of building members such as joists, headers, rim plates and sills exposed.

The present invention requires the removal of the cooler roof, and the installation of a moisture proof 40-50 mil thick sheet polymer roofing membrane onto the cooler wall panels, over the top sill plate, over the top header ledger board and onto the roof, overlapping the sheet polymer roofing material that covers the roof, to which is it welded thus making an impermeable seal. A similar arrangement is utilized at the floor/wall juncture. To ensure that there are no perforations in the sealed unit, a flexible polymer mastic and a double sealing strip are incorporated thereby ensuring the unitary integrity of the system.

Henceforth, a vapor intrusion retardant system and method of installation would fulfill a long felt need in the commercial refrigeration industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a system that is able to retard the ingress of water moisture into a commercial freezer structure, therein minimizing the damage to the building, its contents and appurtenances.

It has many of the advantages mentioned heretofore and many novel features that result in a new vapor intrusion retardant system which is not anticipated, rendered obvious, suggested, or even implied by any of the prior art, either alone or in any combination thereof.

In accordance with the invention, an object of the present invention is to provide an improved vapor intrusion retardant system and method of installation that is capable of being retrofitted onto a flat roof refrigeration structure.

It is another object of this invention to provide an improved vapor intrusion retardant system capable of seamless integration with the refrigeration structure's roofing system.

It is a further object of this invention to provide a vapor intrusion retardant system that seamlessly isolates the roof/wall junction from the structure's internal refrigeration cavity.

It is still a further object of this invention to provide for a vapor intrusion retardant system and method of installation that can eliminate the maximum amount of moisture infiltration form the roof/wall and the floor/wall junction areas.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Similarly, while the material properties of the preferred embodiment materials are extensive, there are a plethora of readily available equivalent materials well known in the art that can be substituted, and render satisfactory results. Therefore, the following detailed description is not to be taken in a limiting sense, and the scope of the present invention is defined by the appended claims and their equivalents.

The largest problem with commercial meat and perishable product coolers/freezers is the infiltration of moisture. This normally occurs at the junction where the floor and/or roof meet the walls due to the connection methods of the dissimilar building materials. (The wall structures are generally insulated panels that are interlocked utilizing a set of vapor proof seals between panels such that vapor intrusion through the wall structure is negligible.) Warm moist outside air is drawn into the cooler because of the lower pressure therein. Once inside it forms ice which lowers the cooler temperature and causes freezer burn. However, much of the moist warm air does not make it all the way into the freezer, but rather condenses into water droplets and possibly ice, somewhere between the outer face and the inner side of the outside walls, or between the top of the roofing material and the roof supports (trusses or rafters.) This water/ice can rot and destroy the structural integrity of a building in a relatively short time frame.

The present invention is a system that retards the intrusion of vapor into a refrigerated building and its method of installation. This vapor intrusion retardant system (VIRS) has two sealing components, a refrigerator upper seal (illustrated as the roof/wall seal of FIGS. 1 and 2) and a refrigerator lower seal (illustrated as one of the floor/wall seals of FIGS. 3 and 4.) The upper seal is the primary barrier to vapor intrusion, and in the majority of situations, this upper seal alone is sufficient to achieve the overall goal of minimized vapor intrusion. A lower seal serves to further retard the unwanted intrusion of water vapor.

Figure 1:
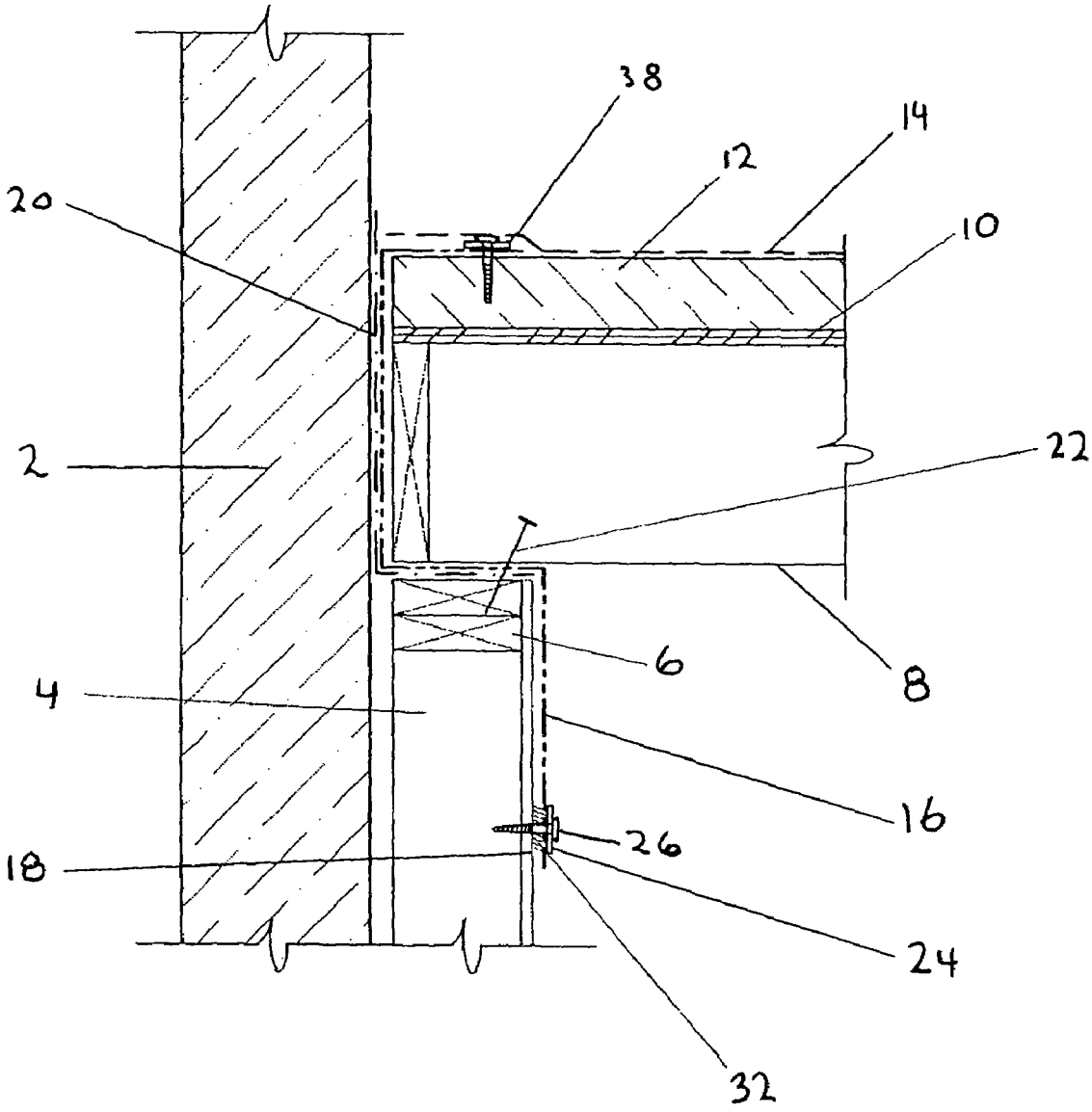
FIG. 1 is a side cross sectional view showing the general arrangement of the vapor intrusion retardant system at the wall/roof junction of a refrigeration structure.
Figure 2:
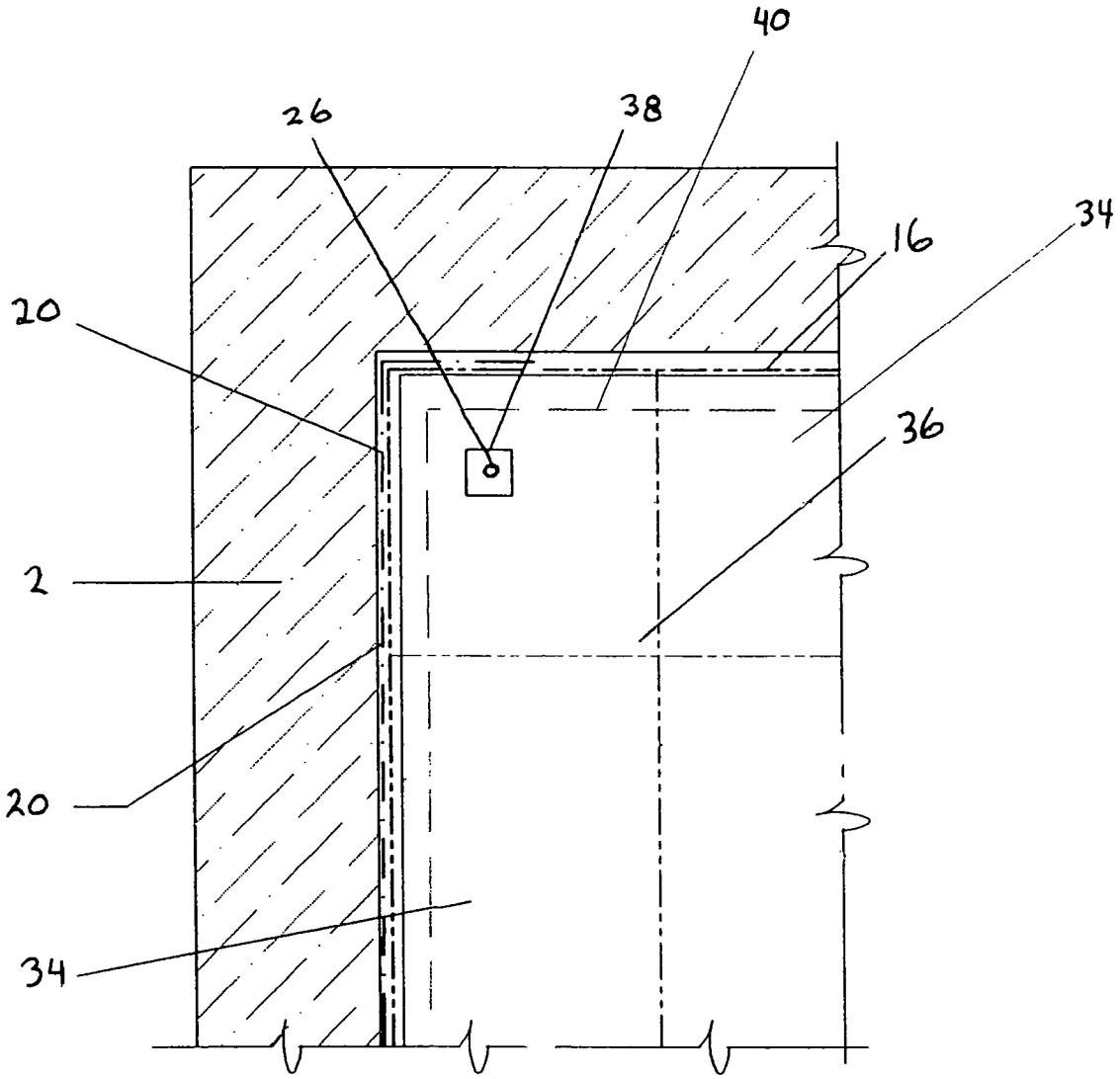
FIG. 2 is a top cross sectional view showing the general arrangement of the vapor intrusion retardant system at a wall/roof junction corner of a refrigeration structure.

Referring to FIG. 1 it can be seen that the top of the refrigerator building is constructed from insulated cooler panel walls 2 affixed to a frame wall generally built from vertically orientated stud framing members 4 having horizontal top plate framing members 6 thereon. A planar wall cover 18 is attached to the stud framing members 4 to finish the internal side of the frame wall and possible constrain further insulation between the stud framing members 4. The ends of the horizontal joist framing members 8 rest atop the top plate framing members 6 to form a roof support upon which a single or double layer plywood planar substrate 10 or the equivalent is affixed. Rigid insulation members 12 are bonded to the planar substrate 10 and a roofing membrane 14 is affixed atop the insulation members 12. To eliminate vapor intrusion between the roof/wall junction, the present invention seamlessly integrates the roofing membrane 14 with a wall membrane 16 in the following manner.

With the joist framing members 8, plywood substrate 10, rigid insulation 12 and roofing membrane 14 removed, a medium weight solvent release mastic 20 is applied to the inner face of the wall panel 2 and the top face of the top plate framing member 6. (Although not illustrated in FIG. 1 as such, it may extend partially downwards onto the wall cover 18.) This mastic 20 is a high tack, trowelable sealant composition containing synthetic rubber and resin as base products so as to provide excellent water resistant properties as well as adhesion. It adheres to a plethora of building materials such as masonry, wood, metal, insulation and galvanized flashing. Such mastic 20 is well known in the industry and marketed under such trade names as Duro-Last SB 240 Mastic.

Figure 7:
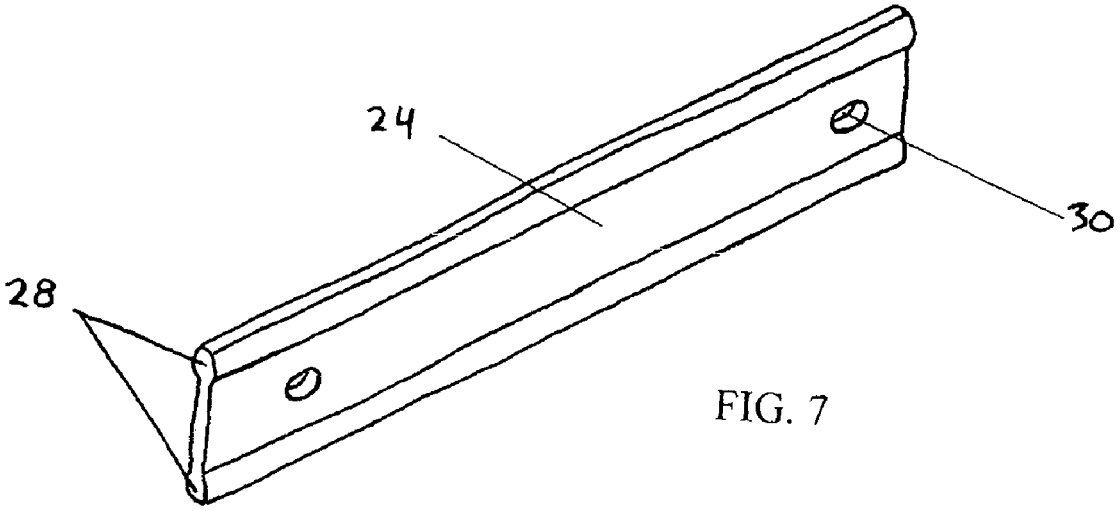
FIG. 7 is a perspective side view of a termination bar geomembrane fastener.

A wall membrane 16 is placed over the inner face of the wall panel 2 adjacent where the joist framing members 8 contact the wall panel 2, where the joist framing members 8 rest on the top plate framing members 6, and over a section of the wall cover 18. When being applied, the wall membrane 16 is pressure rolled on top of the mastic 20 so as to ensure complete adherence without any air pockets between the mastic 20 and the wall membrane 16 and all other surfaces the mastic 20 contacts. In this manner any perforations in the wall membrane 16 caused by the mechanical connectors joining the roof to the walls 22 will remain sealed. Where the wall membrane meets itself, its distal and proximate ends are overlapped and seam welded. Optionally, caulking 32 may be placed between their faces where they overlap. The lower end of the wall membrane is attached to the wall cover 18 by a termination bar 24 (FIG. 7) that resides atop the wall membrane 16 and is attached to the wall cover 18 by corrosion resistant mechanical fasteners 26. Preferably these fasteners 26 are screws with or without a washer means. An optional strip of caulking 32 may be placed between the wall covering 18 and the wall membrane 16 directly beneath the termination bar 24 to enhance the integrity of the upper seal.

The wall and roofing membranes are substantially similar alkaline resistant, UV resistant, flexible, scrim reinforced thermoplastic Geomembranes that are tear and puncture resistant as well as chemical resistant. They offer protection from atmospheric pollutants and chemical contaminates. They are comprised of resins, stabilizers, plasticizers, fungicides, flame retardants and UV absorbers. They are capable of seam-welding by such common methods as hot air, chemical, dielectric and edge wedge as is well known in the art. The preferred embodiment is 40-50 mil thick so as to allow sufficient flexibility without cracking, however this range is not limiting.

The termination bar 24 is a resilient planar strip formed with raised sealing beads 28 on either side, and orifices 30 formed there through to accommodate fasteners 26. When the fasteners 26 are engaged through the orifices 30 and screwed through the wall membrane 16, the optional caulking 32 and into the wall cover 18, pressure is exerted through the sealing beads 28 so as to act as a double sealing means between the wall membrane 16 and the wall cover 18.

The caulking 32 is a self leveling, easy flowing, high tack strength, non crazing, UV resistant silicone caulking that is moisture resistant (water insoluble) and formulated for adhesion to all types of building materials. Preferably it is a urethane compound that is chemically compatible with the wall membrane 16.

With the wall membrane 16 in place, the horizontal joist framing members 8 are connected to the top plate framing members 6 and the wall panels 2, then the plywood substrate 10 and insulation members 12 are attached to the joist framing members 8. The wall membrane 16 is folded down onto the insulation members 12. (Illustrated in FIG. 2 as single fold zones 34.) At the corners of the roof, the wall membrane 16 is corner cut and double folded onto itself. (Illustrated in FIG. 2 as double fold zone 36) Plate fasteners 38 with mechanical fasteners 26 act as a wall membrane securement means to secure the wall membrane 16 to the insulation members 12.

Plate fasteners 38 are rigid polymer plates (circular or otherwise) that have points 42 extending normally from one side thereof. A central stopped bore 44 is formed therein with a thin web of material thereover 46 so as to engage and constrain any mechanical fastener for ease of installation. As a mechanical fastener is screwed through the wall membrane 16, the plate fastener points 42 pierce the wall membrane 16 and extend into the insulation 12 thereby imparting a very strong mechanical attachment between the insulation 12 and the wall membrane 16.

Finally, the roof membrane 14 is affixed atop the insulation members 12, extending over plate fasteners 38. The roof membrane 14 is seam welded to the wall membrane 16 at a location indicated by weld seam 40. The seam welding melts the wall membrane 16 and the roof membrane 14 together to form a unitary polymer sheet, therein forming a vapor proof roof/wall junction seal. Any penetrations or tears of this upper seal will most likely occur in an area that has mastic or caulking seal protection, and thus there will be no vapor intrusion.

Testing has shown that generally, an upper seal will serve to reduce the amount of vapor intrusion to an acceptable level, especially when considering the cost of removing and replacing the roof. However the use of a second, lower seal will further retard the unwanted intrusion of water vapor. In the case of new structures either an interior refrigerator lower seal can be used (reference FIG. 3) or an exterior refrigerator lower seal can used (reference FIG. 4.)

Figure 3:
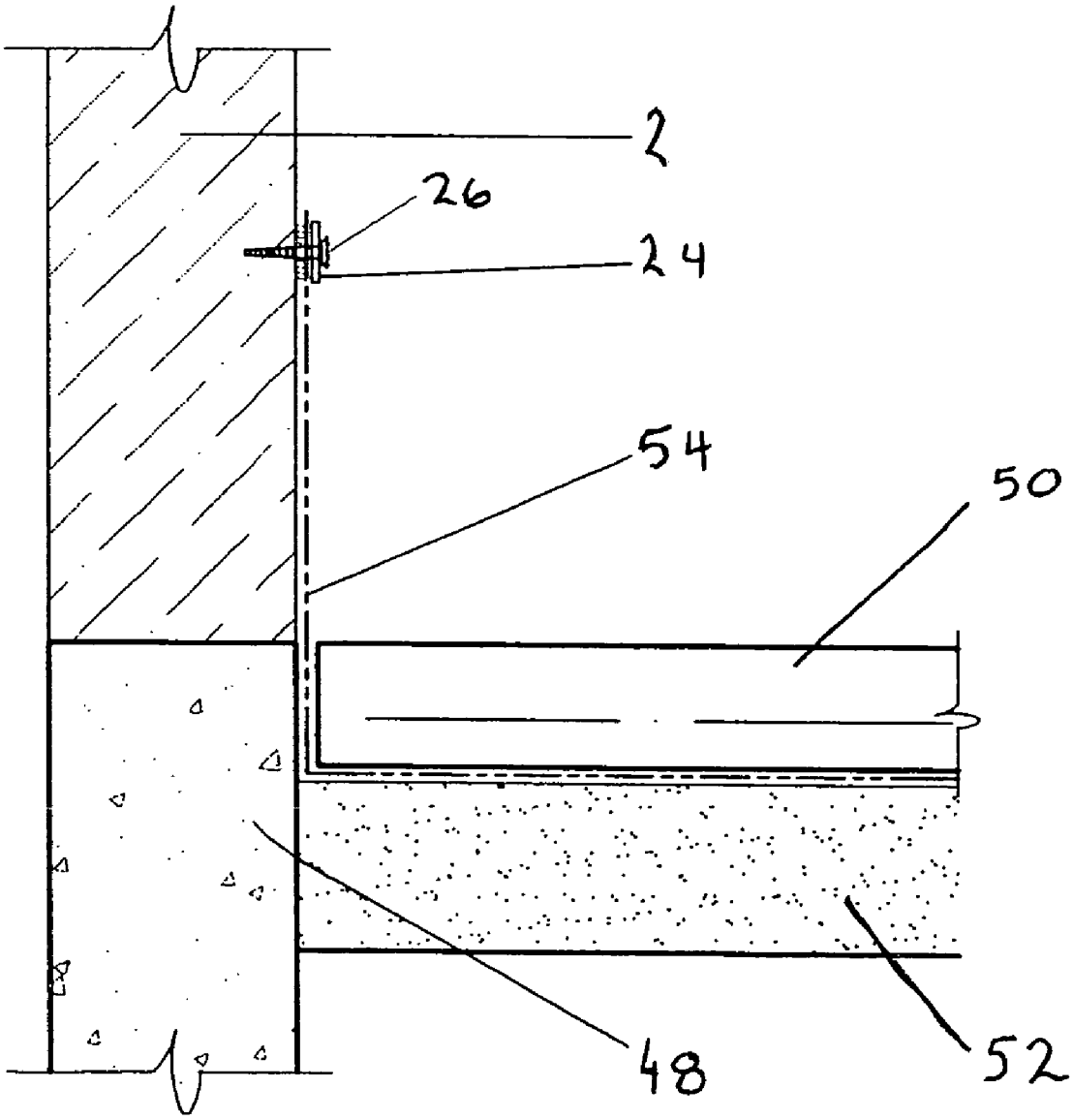
FIG. 3 is a side cross sectional view showing the general arrangement of the interior embodiment vapor intrusion retardant system at the wall/floor junction of a refrigeration structure.
Figure 4:
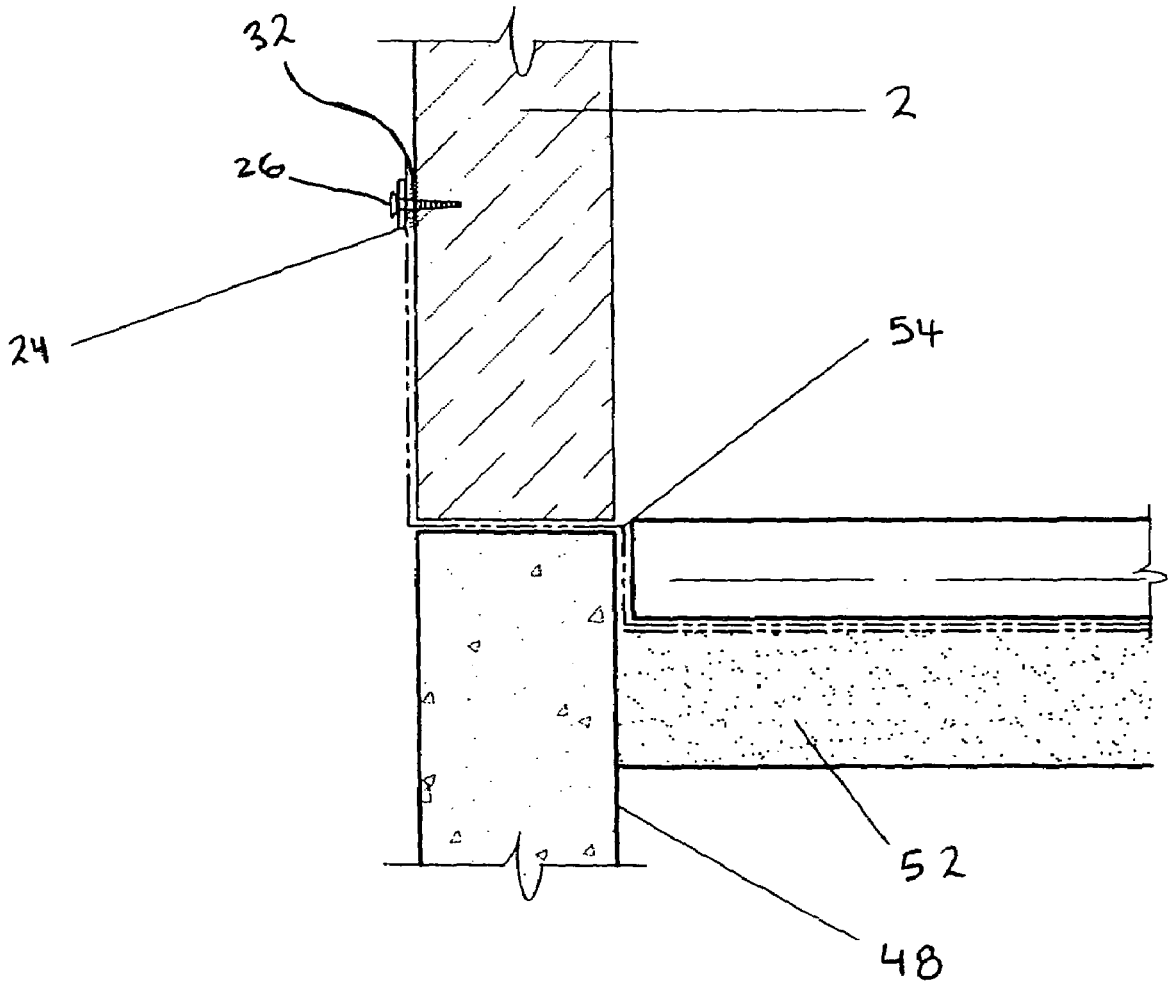
FIG. 4 is a side cross sectional view showing the general arrangement of the exterior embodiment vapor intrusion retardant system at the wall/floor junction of a refrigeration structure.
Figure 5:
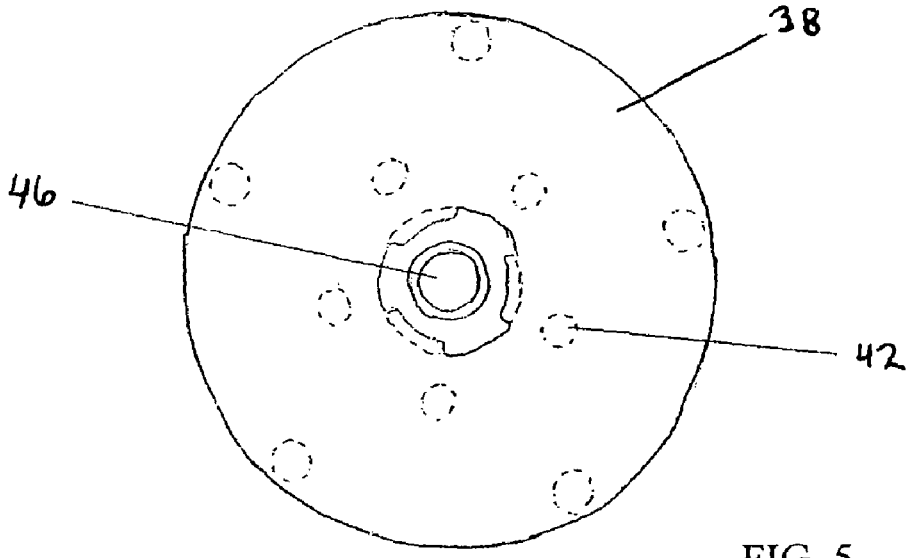
FIG. 5 is a phantom top view of a poly plate geomembrane fastener.
Figure 6:
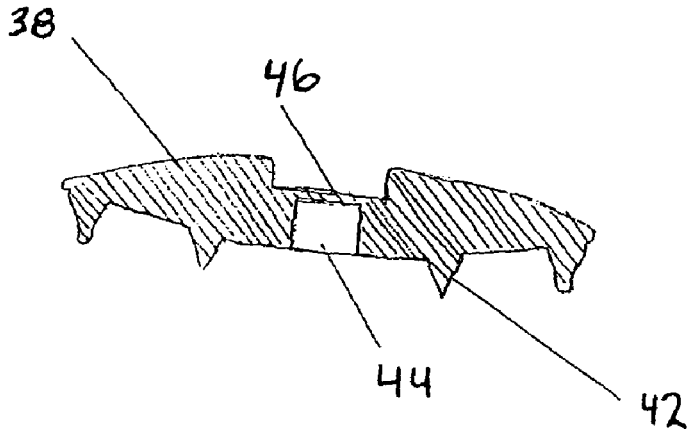
FIG. 6 is a cross sectional side view of a poly plate geomembrane fastener.

Referring to FIGS. 3 and 4 it can be seen that the bottom of the refrigerator building is constructed from insulated cooler panel walls 2 affixed atop of a foundation wall 48, generally concrete. Extending normally from the foundation wall 48 is a concrete floor slab 50 that is formed atop a granular base fill 52. (The stud framing members 4 illustrated in FIG. 1 will not have been erected at the time the lower seal is installed.)

To eliminate vapor intrusion between the floor/wall junction, (and minimize radon intrusion) an alkaline resistant floor membrane 54, which is substantially similar to the roof membrane 14 and the wall membrane 16, is seam welded to form a unitary seamless sheet that is placed atop the granular base fill 52 (before the concrete floor slab is poured and leveled) and extended up between the interface of the foundation wall 48 and the concrete floor slab 50 and either partially up onto the inside of the wall panel 2 where it is secured to the wall panel 2 with a termination bar 24 and a corrosion resistant mechanical fastener 26, or between the foundation wall 48 and the wall panel 2 and then up onto the exterior of wall panel 2 where it is secured to the wall panel 2 with a termination bar 24 and a corrosion resistant mechanical fastener 26. In each of these embodiments a caulk 32 is applied to the wall panel 2 in the area below and adjacent the termination bar 24 to minimize any vapor infiltration from the mechanical fastener penetration.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A method of retarding vapor intrusion into a building comprising the steps of:
   1. removing a roof structure of said building;
   2. applying a water resistant, synthetic high tack mastic to all wall panels and all peripheral vertical roof supports on the areas that contact said roof structure;
   3. applying a first water insoluble caulking strip in a ring about said building on an interior surface of said wall panels;
   4. installing a first membrane such that a first edge of said first membrane overlaps said first caulking strip and said first membrane resides atop said applied synthetic mastic;
   5. affixing said first edge of said first membrane to said wall panels with mechanical fasteners that compress a double sealing strip means on said first membrane, adjacent to said first edge and atop said first caulking strip;
   6. pressure rolling said first membrane into said mastic to eliminate air pockets and improve adhesion;
   7. replacing said roof structure;
   8. folding said first membrane onto a top surface of said roof structure;
   9. affixing said first membrane to said top surface of said roof structure with at least one mechanical fastener and polymer wall membrane securement means;
   10. installing a seam sealed unitary second membrane over said roof and overlapping said second membrane onto the exposed roof sections of said second membrane;
   11. seam seal said second membrane to said first membrane so as to form a unitary membrane seal about said roof structure.

2. The method of retarding vapor intrusion into a building of claim 1 further comprising the following sequential steps after step 11;
   12. installing a seam sealed unitary third membrane under and adjacent to a bottom surface of a floor slab of said building, all side surfaces of said building floor slab, and partially up onto an interior surface of said wall panels of said building;
   13. applying a second water insoluble caulking strip in a ring about said building on said interior surface of said wall panels;
   14. affixing said third membrane to said wall panels with mechanical fasteners that compress a double sealing strip means residing atop said first membrane, and said second caulking strip.

3. The method of retarding vapor intrusion into a building of claim 1 further comprising the following sequential steps after step 11;
   12. installing a seam sealed unitary third membrane adjacent to a bottom surface of a floor slab of said building, all side surfaces of said building floor slab, an internal surface of said foundation wall, between said foundation wall and said wall and partially up onto an exterior surface of said wall panels of said building;
   13. applying a second water insoluble caulking strip in a ring about said building on said exterior surface of said wall panels;
   14. affixing said third membrane to said wall panels with mechanical fasteners that compress a double sealing strip means residing atop said first membrane, and said second caulking strip.

4. The method of retarding vapor intrusion into a building of claim 1 wherein said membranes are seamless, planar, alkaline resistant, UV resistant, flexible, scrim reinforced thermoplastic geomembranes, and wherein said mastic is a high tack, water resistant, trowelable synthetic rubber mastic sealant, and wherein said caulking is a self leveling, easy flowing, high tack strength, non crazing, water insoluble, UV resistant urethane compound silicone caulking, and wherein said a membrane double sealing strip means is a planar strip having a beaded first and second elongated sealing edge, and wherein said mechanical fasteners are corrosion resistant screws, and wherein said membrane securement means are polymer plates with teeth extending normally from a bottom surface thereof.

5. A seal for minimizing vapor intrusion into a building between a building roof, a building wall, vertical roof support members, building floor slab, and building foundation wall comprised of:

a seamless, planar, alkaline resistant, UV resistant, flexible, scrim reinforced thermoplastic roof geomembrane;

a seamless, planar, alkaline resistant, UV resistant, flexible, scrim reinforced thermoplastic wall geomembrane;

a high tack, water resistant, trowelable synthetic rubber mastic sealant;

a self leveling, easy flowing, high tack strength, non crazing, water insoluble, UV resistant urethane compound silicone caulking;

a geomembrane double sealing strip means;

at least one corrosion resistant mechanical fastener; and at least one polymer wall membrane securement means;

wherein a first edge of said wall geomembrane is secured to an inside surface of said wall by at least one said mechanical fastener passing through said double sealing strip means and said caulking which is sandwiched between said wall and said wall geomembrane, and wherein a second edge of said wall geomembrane is secured to an exterior surface of said roof by at least one said mechanical fastener passing through said wall membrane securement means residing atop at least one layer of said wall geomembrane, and wherein said wall geomembrane resides between said roof and said vertical roof support members as well as between said wall and said roof; and wherein said mastic sealant resides between said wall geomembrane and said wall and between said wall geomembrane and said vertical roof support members, and wherein said roof geomembrane extends over said wall geomembrane and said wall membrane securement means and said geomembranes are seam sealed so as to form a unitary seal between said wall and said roof of a building.

6. The seal of claim 5 wherein said roof geomembrane and said wall geomembrane each have a thickness of at least 40 mil.

7. The seal of claim 5 wherein said wall geomembrane is corner cut and double wrapped onto said roof at corners of said roof.

8. The seal of claim 5 further comprising a unitary floor geomembrane that resides adjacent to a bottom surface of said floor slab of said building, all side surfaces of said building floor slab, and partially up onto said walls of said building.

9. The seal of claim 8 wherein said floor geomembrane has a thickness of at least 40 mil.

10. The seal of claim 9 further comprising:

a self leveling, easy flowing, high tack strength, non crazing, water insoluble, UV resistant urethane compound silicone caulking;

a geomembrane double sealing strip means;

at least one corrosion resistant mechanical fastener;

wherein said floor geomembrance is affixed to said walls by at least one said mechanical fastener passing through said double sealing strip means, at least one layer of said floor geomembrane and said caulking which is sandwiched between said wall and said floor geomembrane.

11. The seal of claim 10 wherein said floor geomembrane is corner cut and double wrapped onto said walls at internal corners of said walls.

12. The seal of claim 10 wherein said unitary floor geomembrane also resides adjacent to an internal surface of said foundation wall and between said foundation wall and said wall.

13. The seal of claim 12 wherein said floor geomembrane is diagonally corner cut and double wrapped onto external corners of said walls.

* * * * *